US007973616B2

(12) United States Patent
Shijo et al.

(10) Patent No.: US 7,973,616 B2
(45) Date of Patent: Jul. 5, 2011

(54) POST-WALL WAVEGUIDE BASED SHORT SLOT DIRECTIONAL COUPLER, BUTLER MATRIX USING THE SAME AND AUTOMOTIVE RADAR ANTENNA

(75) Inventors: Tetsu Shijo, Fuchu (JP); Shuichi Obayashi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 207 days.

(21) Appl. No.: 12/405,979

(22) Filed: Mar. 17, 2009

(65) Prior Publication Data

US 2009/0303145 A1 Dec. 10, 2009

(30) Foreign Application Priority Data

Jun. 5, 2008 (JP) ..... 2008-148436

(51) Int. Cl.
*H01P 5/12* (2006.01)
*H01P 3/12* (2006.01)

(52) U.S. Cl. ..... 333/113; 333/239

(58) Field of Classification Search ..... 333/113, 333/239, 248
See application file for complete search history.

(56) References Cited

OTHER PUBLICATIONS

Cheng et al., Millimetre-waveguide monopulse antenna incorporating substrate waveguide phase shifter, Feb. 2008, IET Micro. Antennas Propag., 48-52.*
Wu et al., The Substrate Integrated Circuits—A new Concept for High-Frequency Electronics and Optoelectronics, Dec. 2003, Microwave Review, 8 pages.*
Chen et al., Development of a Low Cost Microwave Mixer Using a Broad-band substrate Integrated Waveguide (SIW) Coupler, Feb. 2006, IEEE, vol. 16 No. 2, 3 pages.*
Yamamoto, et al., "*A Beam Switching Slot Array with a 4-Way Butler Matrix Installed in Single Layer Post-Wall Waveguides*", IEICE Trans. Commun. Vo. E86-B, No. 5 May 2003, pp. 1653-1659.
Hino, et al., "*A Design of Broad-Band Compact H-Plane Directional Couplers*"; The Institute of Electronics, Information and Commu8nication Engineers, Dec. 2000, pp. 85-92.

* cited by examiner

*Primary Examiner* — Dean O Takaoka
(74) *Attorney, Agent, or Firm* — Ohlandt, Greeley, Ruggiero & Perle, L.L.P.

(57) ABSTRACT

A short slot directional coupler includes a dielectric substrate having both surfaces each covered by a metal film, a first via-hole string and a second via-hole string, each of which has via-holes penetrating through the substrate, and formed so that a distance between the first via-hole string and the second via-hole string is narrow at a center of a length direction of the string and wider along directions of both ends of the string, and a pair of third via-hole strings each having via-holes penetrating through the substrate, and formed between parts adjacent to both ends of the first via-hole string and parts adjacent to both ends of the second via-hole string to form a first post-wall waveguide along with the first via-hole string and a second post-wall waveguide along with the second via-hole string.

9 Claims, 6 Drawing Sheets

POST-WALL WAVEGUIDE BASED SHORT SLOT DIRECTIONAL COUPLER, BUTLER MATRIX USING THE SAME AND AUTOMOTIVE RADAR ANTENNA

CROSS-REFERENCE TO RELATED APPLICATIONS

This application is based upon and claims the benefit of priority from prior Japanese Patent Application No. 2008-148436, filed Jun. 5, 2008, the entire contents of which are incorporated herein by reference.

BACKGROUND OF THE INVENTION

1. Field of the Invention

The invention relates to a post-wall waveguide based short slot directional coupler, a Butler matrix using the same, and an automotive radar antenna.

2. Description of the Related Art

In general, a short slot directional coupler comprises waveguides which differ in width from each other and connected in a multi-stepped form. For example, Akihiro Hino, Tadashi Kawai, Yoshihiro Kokubo, and Isao Ohta "A Design of Broad-Band Copact H-Plane Directional Coupler" Department of Electronics, faculty of engineering, Himeji Institute of Technology, MW2000-163, (2000-12) (referred to as Akihiro Hino et al. hereinafter) discloses a short slot directional coupler having a coupling region wherein a wall in common of two arrays of waveguides along the length direction thereof which are arranged in parallel is removed, the waveguides having different widths and connected in a multi-stepped form. The multi-stepped structure allows a wide-banded reflection characteristic to be realized for an arbitrary coupling.

On the other hand, it is known to realize a short slot directional coupler by use of so-called post-wall waveguide (referred to, for example, Shin-ichi YAMAMOTO, Jiro HIROKAWA, Makoto ANDO, "A Beam Switching Slot Array with a 4-Way Butler Matrix Installed in a Single Layer Post-Wall Waveguide," IEICE Trans. Commun., Vol. E86-B, No. 5, pp. 1653-1659, May 2003 (referred to as Snin-ichi YAMAMOTO et al. hereinafter). The post-wall waveguide can be fabricated by a printed circuit board processing technique because it is formed of a through hole bored in a dielectric substrate. According to Snin-ichi YAMAMOTO, et al., via-holes are arranged in a waveguide axial direction at an interval not more than about 2 times of a diameter of the via-hole so that a leakage is prevented from the interval.

Also, according to the short slot directional coupler of Snin-ichi YAMAMOTO, et al., two arrays of post wall waveguides each comprised of an array of via-holes arranged in line are located in parallel, and so-called narrow wall surface on which both waveguides are in contact with each other is shared to the two arrays of post wall waveguides. A short slot functioning as a coupling element is formed by removing a part of the shared narrow wall. Further, a step for cutting off a TE30 mode and a post for suppressing a reflection are disposed on the area on which the short slot is formed.

A multi-stepped model short slot directional coupler using the waveguide disclosed in Akihiro Hino, et al. is difficult to fabrication, because the waveguides having different widths need to be connected in a multi-stepped form. On the other hand, the short slot directional coupler using the post-wall waveguide disclosed in Snin-ichi YAMAMOTO, et al. needs reflection suppressing posts. These reflection suppressing posts require high location accuracy, because it is in the area where the slot opens and at the position which the coupling is prevented. As a result, its fabrication is difficult in microwave band and millimeter wave band.

It is an object of this invention to provide in easy and low cost a short slot directional coupler which can suppress the reflection without using the reflection suppressing posts requiring high fabrication accuracy.

BRIEF SUMMARY OF THE INVENTION

According to an aspect of the present invention, there is provided a short slot directional coupler comprising: a dielectric substrate having both surfaces each covered by a metal film; a first via-hole string and a second via-hole string, each of which has via-holes penetrating through the substrate, and formed so that a distance between the first via-hole string and the second via-hole string is narrow at a center the string along a length direction thereof and wider along directions of both ends of the string; and a pair of third via-hole strings each having via-holes penetrating through the substrate, and formed between parts adjacent to both ends of the first via-hole string and parts adjacent to both ends of the second via-hole string to form a first post-wall waveguide along with the first via-hole string and a second post-wall waveguide along with the second via-hole string.

DETAILED DESCRIPTION OF THE INVENTION

There will now be described an embodiment of the present invention in conjunction with the accompanying drawings.

First Embodiment

Figure 1:
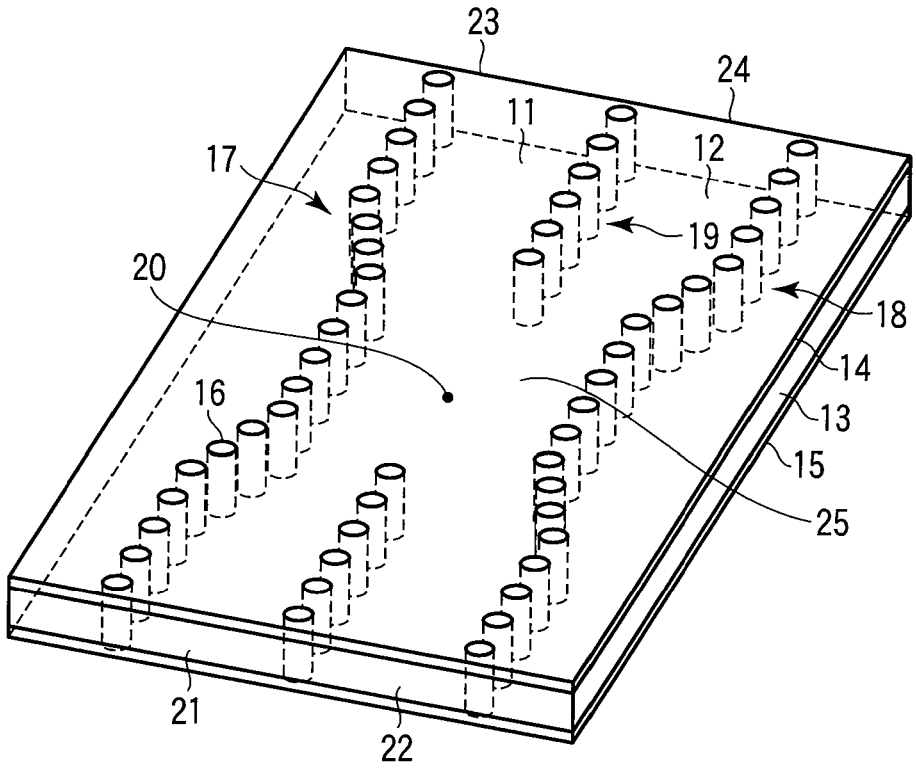
FIG. 1 is a perspective view of a short slot directional coupler according to one embodiment.
Figure 2:
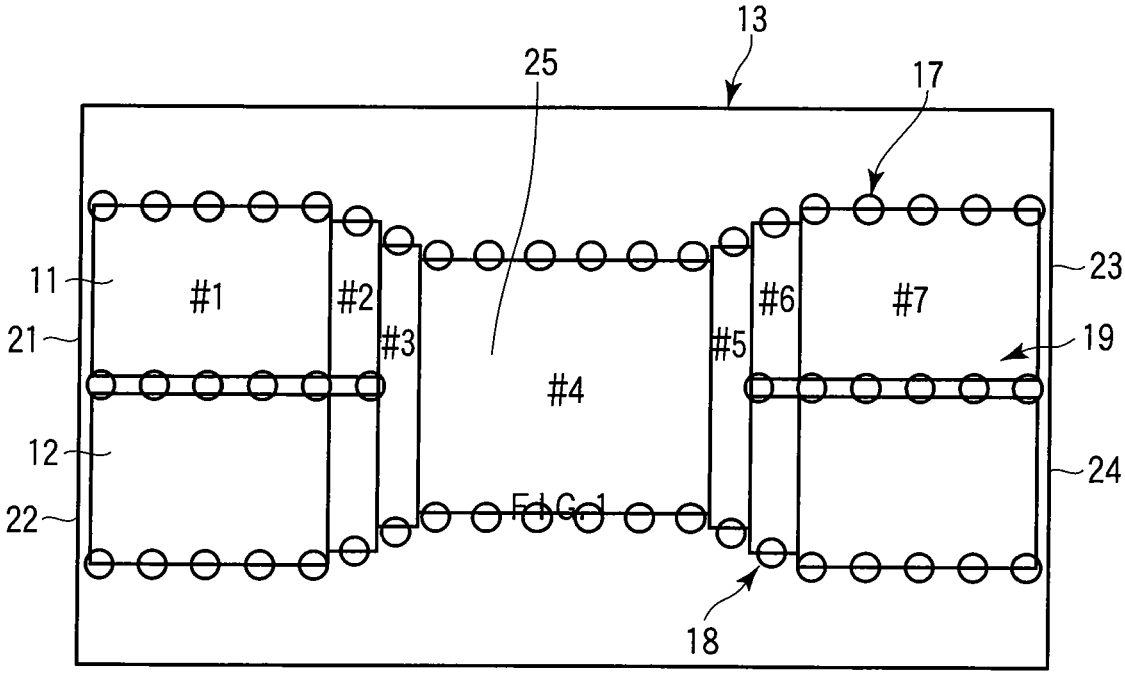
FIG. 2 is a plane view of the short slot directional coupler of FIG. 1.

The short slot directional coupler according to the first embodiment will be explained in conjunction with FIGS. 1 and 2. This short slot directional coupler is realized by use of two post-wall waveguides 11 and 12. The post-wall waveguides 11 and 12 are comprised of a dielectric substrate 13 and via-holes 16 penetrating through the dielectric substrate 13. The upper and lower surfaces of the dielectric substrate 13 are covered by the metal films 14 and 15 made of electric conductor material such as copper. Each via-hole 16 is made of a metal component (referred to as a via-hole component) penetrating through the dielectric substrate 13 and short-circuits the metal films 14 and 15.

First, second and third via-hole strings 17, 18 and 19 each are formed of via-holes 16, and comprise first, second and third post wall waveguides 11, 12 and 25. The first post-wall waveguide 11 is comprised of the first via-hole string 17 and the third via-hole string 19. The second post-wall waveguide 12 is comprised of the second via-hole string 18 and the third via-hole string 19. The first post-wall waveguide 25 is defined by the first via-hole string 17 and the second via-hole string 18. In this way, the via-hole strings 17, 18 and 19 function as post-walls.

One-side ends of the first and second post-wall waveguides 11 and 12 are set as the first and second I/O ports 21 and 22, and other-side ends of the post-wall waveguides 11 and 12 are set as the third and fourth I/O ports 23 and 24.

The via-hole strings 17, 18 and 19 will be explained in detail hereinafter. The first via-hole string 17 and the second via-hole string 18 are formed so that the distance between the strings 17 and 18 is narrow at the center of the strings along a length direction thereof and wide at both ends thereof along the length direction. On the other hand, each third via-hole string 19 is formed in line between one of the parts adjacent to both ends of the first via-hole string 17 along the length direction thereof and an opposite one of the parts adjacent to both ends of the second via-hole string 18 along the length direction thereof. As a result, the first post wall waveguide 11 is formed between the first via-hole string 17 and the third via-hole string 19. Also, the second post wall waveguide 12 is formed between the second via-hole string 18 and the third via-hole string 19. Further, the third post wall waveguide 25 is formed between the first via-hole string 17 and the second via-hole string 18 by use of the center portions of them as post walls.

The first and second post-wall waveguides 11 and 12 share the wall corresponding to the narrow portion of each waveguide. A short slot 20 functioning as a coupling element is formed by removing the shared wall along the length direction of the waveguides. The third post-wall waveguide 25 is defined by the first and second via-hole strings 17 and 18 so as to contain an area on which the short slot 20 is formed.

Two strings of post-wall waveguides according to Shin-ichi YAMAMOTO et al. are formed of via-hole strings arranged in line, whereas the post-wall waveguides 11 and 12 according to the present embodiment are defined by the first and second via-hole strings 17 and 18 that are meandered and the third via-hole string 19. As a result, the widths of the first post-wall waveguide 11, second post-wall waveguide 12 and third post wall waveguide 25 vary in a multi-stepped form. Concretely, in the present embodiment, as shown in FIG. 2, an interval between the first via-hole line 17 and the second via-hole line 18 varies in seven stages as shown in, for example, #1 to #7. In other words, the short slot directional coupler according to the present embodiment is realized by a multi-stepped short slot directional coupler using a waveguide as disclosed by Akihiro Hino, et al.

Also, the short slot directional coupler according to the present embodiment does not require such a step that a TE30 mode is cutoff in an area on which a coupling slot is formed and reflection suppressing posts with comparison with a short slot directional coupler using a conventional post-wall waveguide as disclosed in Snin-ichi YAMAMOTO et al. By making a multi-stepped short slot directional coupler using the post-wall waveguide in this way, a reflection to an arbitrary coupling can be suppressed without using the reflection suppressing posts.

Figure 3:
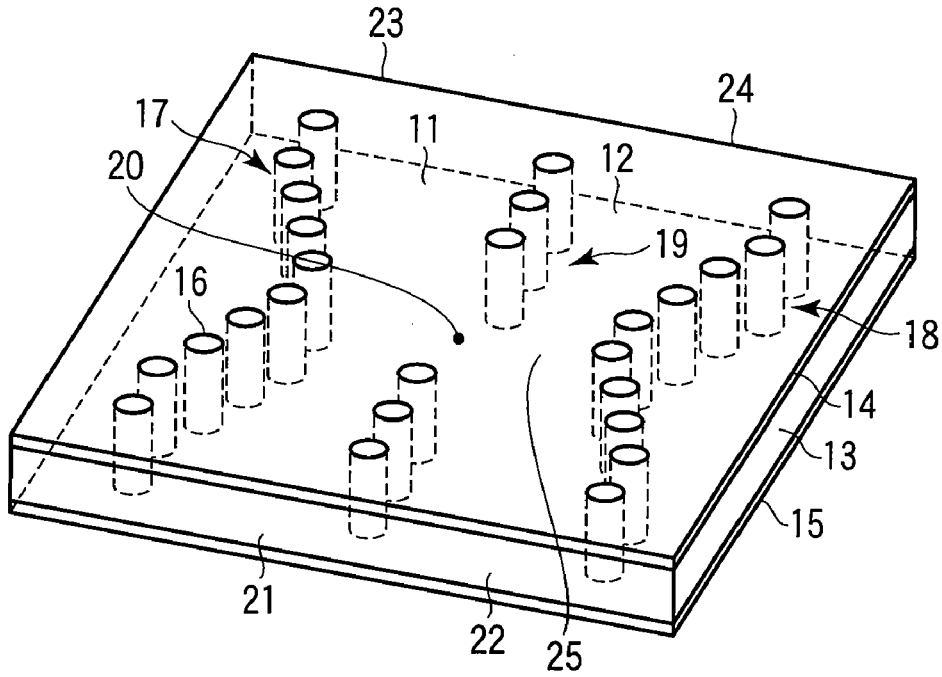
FIG. 3 is a perspective view of the 3 dB hybrid coupler realized using the short slot directional coupler according to the one embodiment.
Figure 4:
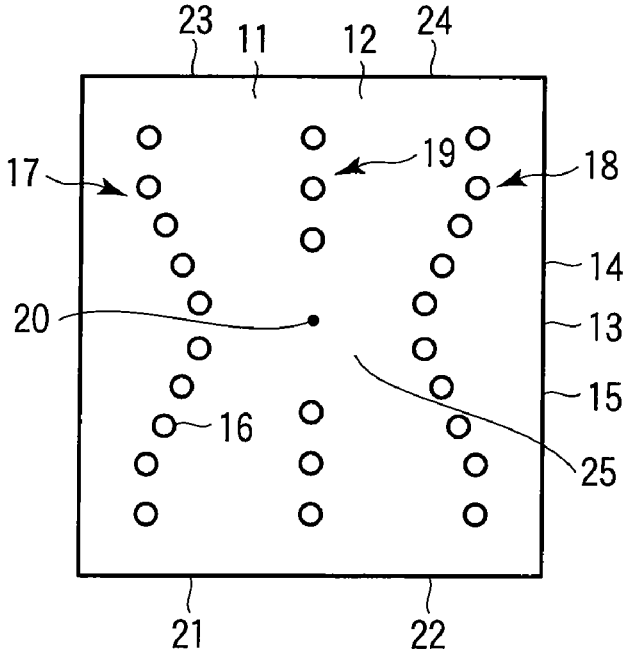
FIG. 4 is a plane view of the coupler of FIG. 3.

FIGS. 3 and 4 show an example of realizing a hybrid coupler of a 3 dB coupling (referred to as a 3 dB hybrid coupler) by use of the short slot directional coupler according to the first embodiment. In this case, when a signal power is input to a first I/O port 21, for example, the input signal power is divided equally and output from third and fourth I/O ports 23 and 24.

Figure 5:
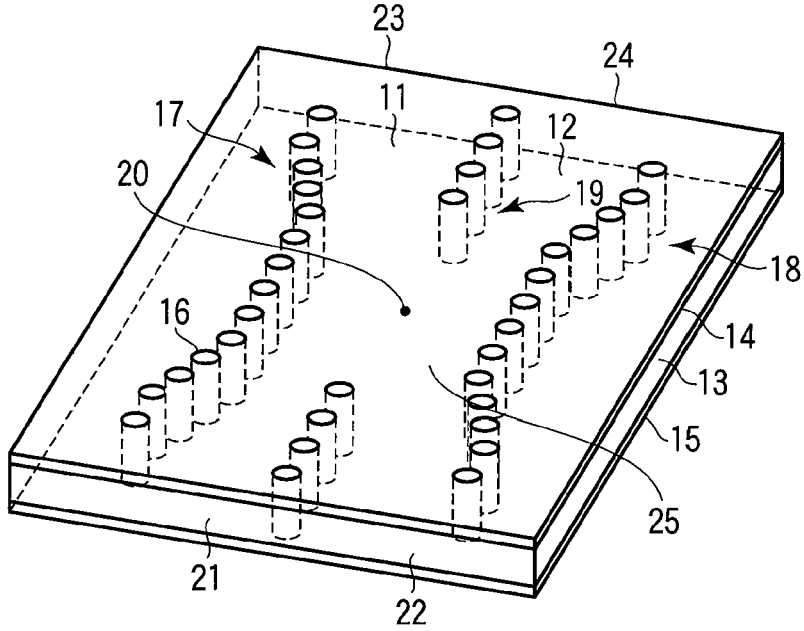
FIG. 5 is a perspective view of a 0 dB cross coupler realized using the short slot directional coupler according to the one embodiment.
Figure 6:
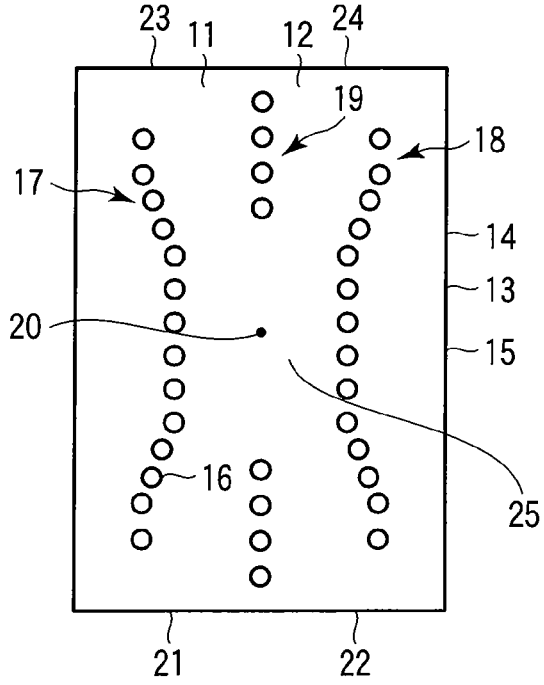
FIG. 6 is a plane view of the coupler of FIG. 5.

FIGS. 5 and 6 show an example of realizing a cross coupler of a coupling quantity of 0 dB by use of the short slot directional coupler according to the first embodiment. In this case, when the signal power is input to the first I/O port 21, for example, the input signal power is output from the fourth I/O port 24.

There will be described a general principle of controlling a coupling quantity in the short slot directional coupler although it is not limited to the present embodiment. A basic mode; TE10 mode and its higher mode; TE20 mode propagate in the coupling region of the short slot directional coupler, because a waveguide width (corresponding to a waveguide) in the coupling region on which the short slot opens broadens. The coupling can be controlled by the short slot length, because the propagation phases of the TE10 mode and TE20 mode differ from each other. If the propagation constants of the TE10 and TE20 modes are $\beta_1$ and $\beta_2$, and the amplitude of incident electric field of the first I/O port is 1, the electric field amplitudes $E_2$ and $E_4$ of the second and fourth I/O ports are calculated as follows.

$$E_2 = \frac{1}{2}(e^{-j\beta_1 l} + e^{-j\beta_2 l}) = e^{-j(\beta_1+\beta_2)l/2}\cos\left\{(\beta_1 - \beta_2)\frac{l}{2}\right\} \tag{2-1}$$

$$E_4 = \frac{1}{2}(e^{-j\beta_1 l} - e^{-j\beta_2 l}) = e^{-j(\beta_1+\beta_2)l/2}\sin\left\{(\beta_1 - \beta_2)\frac{l}{2}\right\} \tag{2-2}$$

where l is a short slot length.

A propagation constant of a TE mn mode with respect to the waveguide (the length of its wide wall is assumed to be a and the length of its narrow wall is assumed to be b) is expressed by the following equations.

$$\beta = \sqrt{\omega^2\varepsilon_r\varepsilon_0\mu_0 - k_c^2} \tag{3-1}$$

$$k_c^2 = \left(\frac{m\pi}{a}\right)^2 + \left(\frac{m\pi}{b}\right)^2 \tag{3-2}$$

Accordingly, the propagation constants $\beta_1$ and $\beta_2$ of TE10 and TE20 modes are expressed by the following equations.

$$\beta_1 = \sqrt{\omega^2\varepsilon_r\varepsilon_0\mu_0 - \left(\frac{\pi}{a}\right)^2} \tag{4-1}$$

-continued $$\beta_2 = \sqrt{\omega^2 \varepsilon_r \varepsilon_0 \mu_0 - \left(\frac{2\pi}{a}\right)^2} \tag{4-2}$$

It is understood from the above equations that the tube width a changes.

When $(\beta_1-\beta_2)½=\pi/4$, $|E_2|=|E_4|=1/\sqrt{2}$. In other words, a 3 dB hybrid coupler is realized. When $(\beta_1-\beta_2)½=\pi/2$, $|E_2|=0$, $|E_4|=1$. In other words, a cross coupler is realized.

Depending on a value of the tube width a, a higher mode not less than TE30 can be propagated, too. In this case, the coupling cannot be controlled by the above equations, and a design becomes complicated. The waveguide width in coupling region on which the short slot opens is determined to be such a value that TE30 mode is cutoff.

There will be described a principle of reflection hereinafter. A primary mode occurring reflection from the short slot is not the TE20 mode in which the amplitude of the electric field becomes 0 at the center of the vertical direction with respect to the propagation direction of the radio wave, but the TE10 mode in which the amplitude of the electric field peaks at the center of the waveguide. Accordingly, it is thought that if the phase constant is adjusted for the TE10 mode so as to set $\beta_1 1$ to $\pi/4$, the reflection from the short slot is suppressed. Such a waveguide width as to satisfy two conditions; the arbitrary coupling and the reflection suppression is chosen. For an oblique step structure to change the waveguide width in the coupling region, a reflection from the step can be suppressed. Since the reflected wave from the step occurs for TE20 mode as well as TE10 mode, suppression of the reflection is difficult.

There will be described the via-hole distance between the via-hole strings 17, 18 and 19 hereinafter. As explained above, the short slot directional coupler according to the present embodiment is configured to have a structure obtained by simulating a multi-stepped short slot directional coupler using a waveguide with post wall waveguides 11 and 12 defined by the via-hole strings 17, 18 and 19. In the short slot directional coupler using a waveguide, an object corresponding to the via-hole string is a sequence of waveguide walls, and the via-hole strings 17, 18 and 19 are realized by arranging posts composed of via-holes discretely. Therefore, in order for leak of a radio wave from the interval between the via-holes to be prevented, it is necessary to consider an interval between the via-holes of the via-hole strings 17, 18 and 19.

According to the preferred embodiment, the interval between the via-holes on an area on which a higher mode not less than the TE20 mode can be propagated in the post-wall waveguides 11, 12 and 25 is set to a value smaller than the diameter of the via-hole. More concretely, in the area that each width w of the post-wall waveguides 11, 12 and 25 satisfies the following equation, each via-hole interval between the via-hole strings 17, 18 and 19 is set to not more than 90% of the diameter of the via-hole.

$$w > \frac{1}{f_0}\frac{c}{\sqrt{\varepsilon_r}} \tag{5}$$

where $f_0$ is an operating frequency, $\in_r$ is relative conductivity of a dielectric substrate, and c is a light velocity.

Generally, it is assumed that if the via-hole interval between the via-hole strings used as the post of the post-wall waveguide is the same as the via-hole diameter, the radio wave is leaked from the post-wall waveguide. Actually, in the TE10 mode, the leak of the radio wave is suppressed by the via-hole interval equal to the via-hole diameter.

However, in the present embodiment, when each waveguide width w of the post-wall waveguides 11, 12 and 25 increases to a degree of satisfying the equation (5), in the case that the higher mode not less than TE20 is excited, if each via-hole interval between the via-holes of the via-hole strings 17, 18 and 19 is the same as the via-hole diameter, the radio wave leaks out. Concretely, when the via-hole interval is the same as the via-hole diameter, a leakage for TE20 mode increases about 10 dB than that for the TE10 mode.

On the other hand, when the via-hole interval is set to a value not more than 90% of the via-hole diameter, the leakage for the TE10 mode from the post-wall waveguides 11, 12 and 25 becomes the same level as the leakage for the TE10 mode when the via-hole interval is set to the same as the via-hole diameter. In this way, when a high frequency circuit using the TE20 mode such as a short slot directional coupler is realized by the post wall waveguide defined by via-holes, the leakage from the post-wall waveguide can be suppressed in minimum by narrowing the via-hole interval on the area on which the radio wave can be propagated in the higher mode not less than the TE20 mode to a value less than the via-hole diameter of the conventional via-hole.

Figure 7:
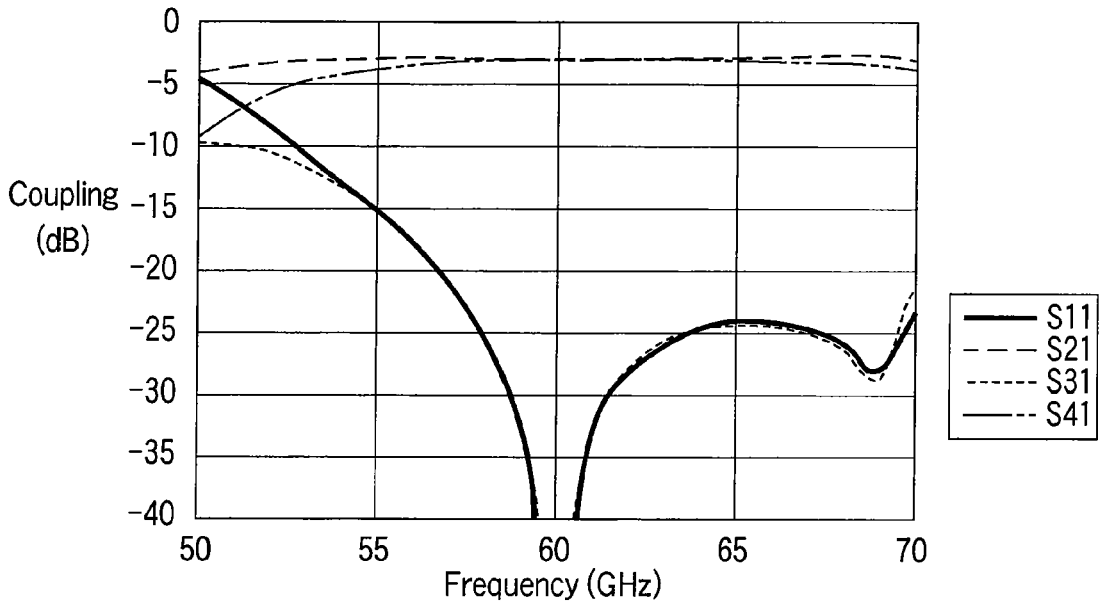
FIG. 7 is a diagram indicating a frequency characteristic of a scattering matrix of the 3 dB hybrid coupler according to the one embodiment.
Figure 8:
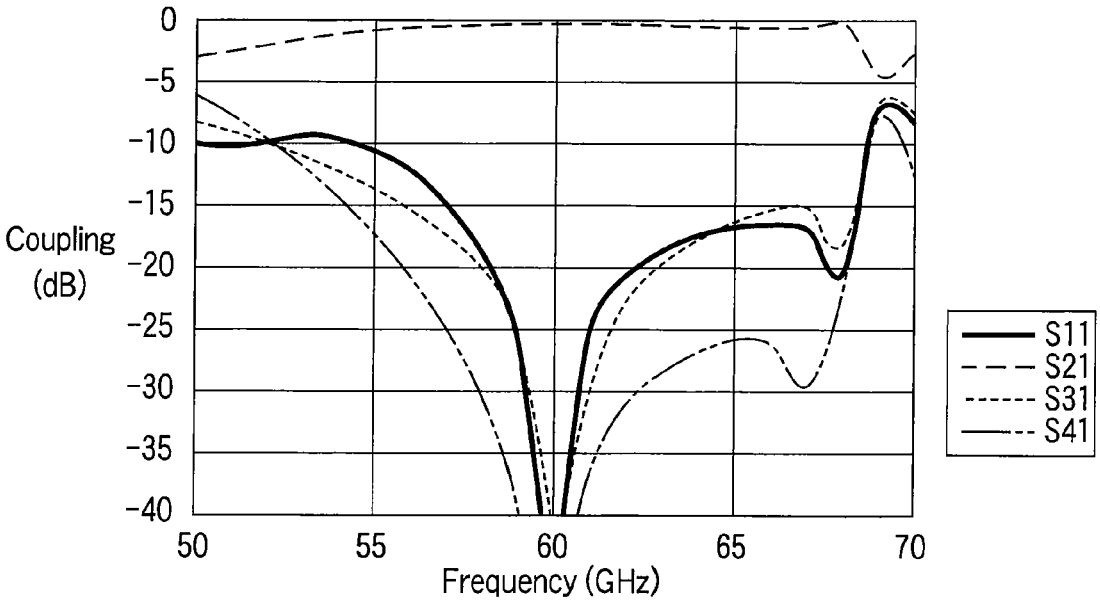
FIG. 8 is a diagram indicating a frequency characteristic of a scattering matrix of a 0 dB cross coupler according to the one embodiment.

It will be described hereinafter that a frequency characteristic of a scattering matrix of the short slot directional coupler according to the present embodiment is obtained by analysis. The frequency characteristic of the scattering matrix of the 3 dB hybrid coupler explained in FIGS. 3 and 4 is shown in FIG. 7. The frequency characteristic of the scattering matrix of the 0 dB cross coupler explained in FIGS. 5 and 6 is shown in FIG. 8. It is found in FIG. 7 or 8 that design frequency is 60 GHz, and a desired coupling is realized in the design frequency, and also, suppression of reflection is realized.

As mentioned above, according to the present embodiment, the short slot directional coupler can be realized easily in low cost by a printed circuit board processing technique. Also, extraneous reflection can be suppressed for an arbitrary coupling without using reflection suppressing posts requiring high fabrication accuracy. Also, the waveguide width can be easily changed only by changing the position of the via-holes, and thus a multi-stepped structure can be easily realized in comparison with use of a metallic waveguide. Therefore, the short slot directional coupler according to the present embodiment provides a high effect in fabrication of a high frequency circuit of, for example, microwave band or millimeter-wave zone.

Second Embodiment

Figure 9:
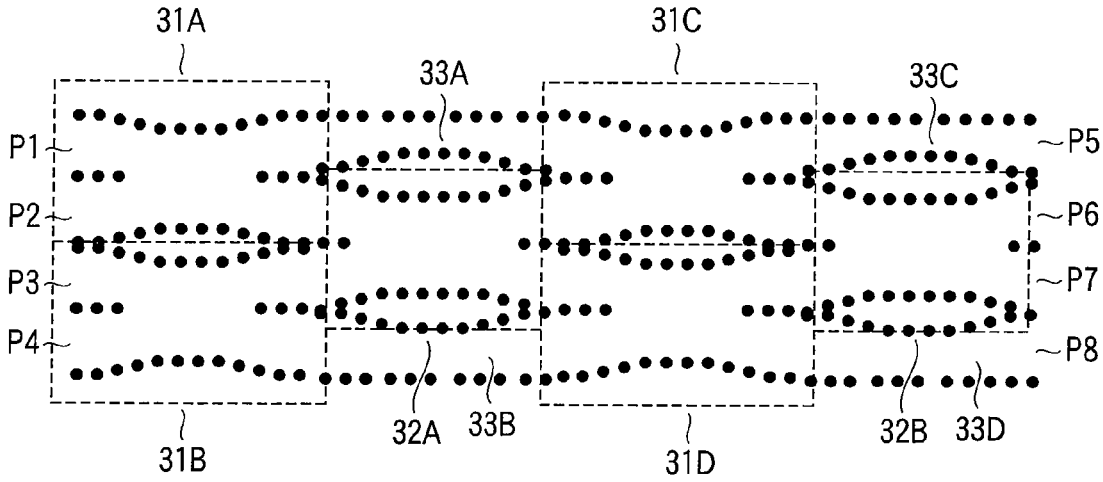
FIG. 9 is a diagram indicating a Butler matrix using a short slot directional coupler according to a second embodiment.

An example applying the short slot directional coupler according to the first embodiment to a Butler matrix will be described hereinafter. As shown in FIG. 9, the Butler matrix comprises 3 dB hybrid couplers 31A to 31D shown in FIGS. 3 and 4, 0 dB cross couplers 32A and 32B shown in FIGS. 5 and 6, and phase shifters 33A to 33D having a phase shifter. The phase shifters 33A to 33D each are comprised of the post-wall waveguide similarly to the coupler.

An example of a 4-way Butler matrix is shown in FIG. 9. Even if a power inputs to any one of input ports P1 to P4, the power is distributed equally from output ports P5 to P8. The input ports P1 and P2 are the first and second I/O ports of the hybrid coupler 31A, and the input ports P3 and P4 are the first and second I/O ports of the hybrid coupler 31B.

The third I/O port which is the output port of the hybrid coupler 31A is connected to the input port of the phase shifter 33A, and the fourth I/O port which is another output port of the hybrid coupler 31A is connected to the first I/O port which is the input port of the cross coupler 32A. Similarly, the third I/O port which is the output port of the hybrid coupler 31B is connected to the second I/O port which is another input port of the cross coupler 32A, and the fourth I/O port which is another output port of the hybrid coupler 31B is connected to the input port of the phase shifter 33B.

The output port of the phase shifter 33A is connected to the first I/O port which is the input port of the hybrid coupler 31C. The third I/O port which is the output port of the cross coupler 32A is connected to the second I/O port which is another input port of the hybrid coupler 31C. The fourth I/O port which is another output port of the cross coupler 32C is connected to the third I/O port which is the input port of the hybrid coupler 31D. The output port of the phase shifter 33B is connected to the fourth I/O port which is another input port of the cross coupler 31D.

The connection relation of the hybrid couplers 31C and 31D with the cross coupler 32B and the phase shifters 33C and 33D are similar to the above. The port P5 of the output ports P5-P8 is the output port of the phase shifter 33C, the ports P6 and P7 are the first and second output ports of the cross coupler 32B, and the port P8 is the output port of the phase shifter 33D.

As described above, the Butler matrix of a single layer structure can be realized by combining the hybrid coupler, the cross coupler and the phase shifter, which are explained in the first embodiment. The Butler matrix according to the present embodiment has the same advantage as the first embodiment fundamentally, because it can be realized by the post-wall waveguide without needing the reflection suppressing posts.

Third Embodiment

Figure 10:
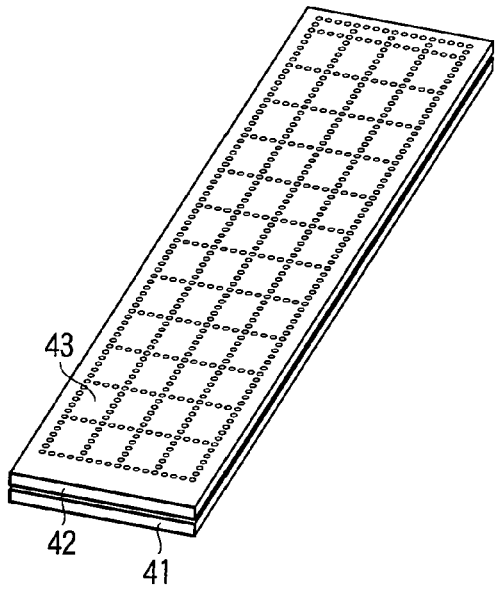
FIG. 10 is a perspective view of an automotive radar antenna using the Butler matrix of FIG. 9, according to a third embodiment.

FIG. 10 shows an automotive radar antenna according to the third embodiment of the present invention. The radar antenna has a two-layer structure wherein a slot array antenna 42 having a plurality of slots 43 is arranged on the Butler matrix 41 using the short slot directional coupler comprised of the post-wall waveguide as shown in FIG. 9. In this case, the Butler matrix 41 is used as a power supply circuit for the slot array antenna 42.

Fourth Embodiment

Figure 11:
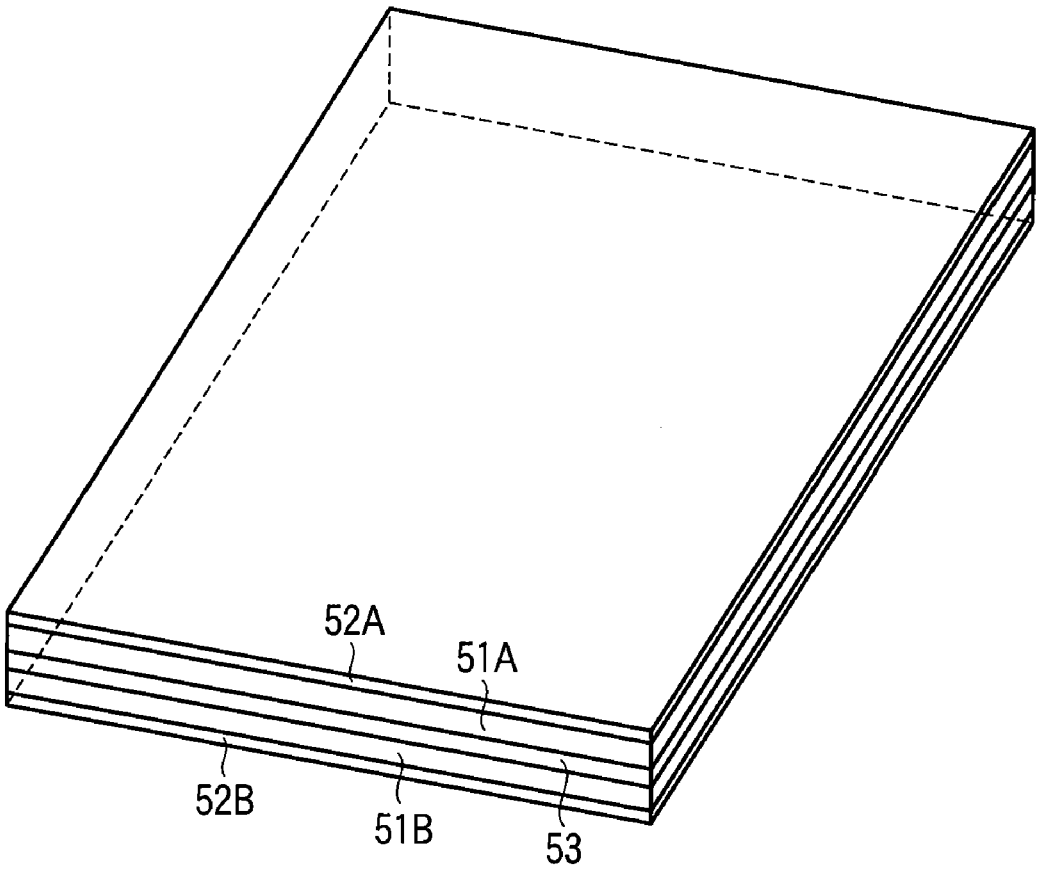
FIG. 11 is a perspective view of a short slot directional coupler according to a fourth embodiment.
Figure 12:
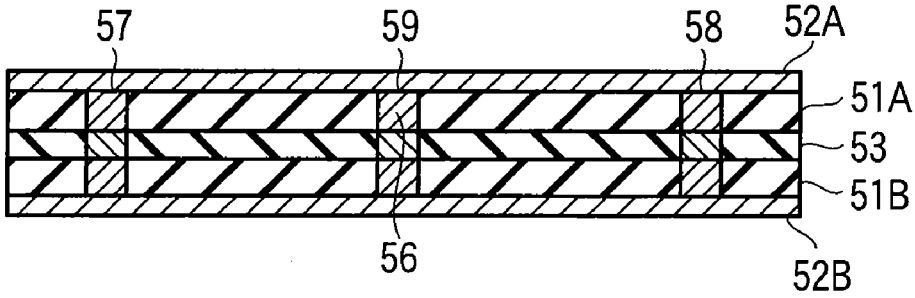
FIG. 12 is a sectional view of the short slot directional coupler according to the fourth embodiment.

FIGS. 11 and 12 show a short slot directional coupler according to the fourth embodiment, and comprised of a dielectric waveguide formed of a multilayer dielectric substrate. First and second dielectric substrates 51A and 52B having one-side surfaces on which metal films 52A and 52B are deposited respectively are laminated with interposing an intermediate dielectric layer 53 therebetween.

First, second and third via-hole strings 57, 58 and 59 formed of via-holes 56 are formed in the first dielectric substrates 51A and 52B similarly to the first embodiment. A metal pad 59 is provided in the intermediate dielectric layer 53 at the position of the via-hole 56. This metal pad 59 connects the via-hole member penetrating through the dielectric substrate 51B and the via-hole member penetrating the through dielectric substrate 51A electrically, whereby the via-hole 56 penetrating through the dielectric substrate 51A, the intermediate dielectric layer 53 and the through dielectric substrate 52B are formed.

In this way, even if the short slot directional coupler is realized by the dielectric waveguide using the multilayer dielectric substrate, an advantage capable of suppressing reflection unnecessary for an arbitrary coupling quantity without using the reflection suppression post is provided by configuring the via-hole strings 57, 58 and 59 similarly to the first embodiment. Also, when each distance between the via-hole strings 57, 58 and 59 is set to a value smaller than the via-hole diameter in the area on which the higher mode not less than TE20 as expressed by the equation (5) is excited, preferably not more than 90% of the via-hole diameter, a leakage is suppressed.

According to the present invention, there is provided a short slot directional coupler without using the reflection suppressing posts by a printed circuit board processing technique using a post-wall waveguide easily in low cost.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A short slot directional coupler comprising:

a dielectric substrate having both surfaces each covered by a metal film;

a first via-hole string and a second via-hole string, each of which has via-holes penetrating through the substrate, and formed so that a distance between the first via-hole string and the second via-hole string is narrow at a center of the string and wider along directions of both ends of the string; and a pair of third via-hole strings each having via-holes penetrating through the substrate, and formed between parts adjacent to both ends of the first via-hole string and parts adjacent to both ends of the second via-hole string to form a first post-wall waveguide along with the first via-hole string and a second post-wall waveguide along with the second via-hole string, wherein each via-hole interval in the first via-hole string, the second via-hole string and the third via-hole string is set to a value not more than 90% in an area on which each width of the first post-wall waveguide, the second post-wall waveguide and third post wall waveguides defined by the first via-hole string and the second via hole string satisfies a following equation:

$$w > \frac{1}{f_0}\frac{c}{\sqrt{\varepsilon_r}}$$

where $f_0$ represents an operating frequency, $\in_r$ represents a relative conductivity of the substrate, and c represents a light velocity.

2. The short slot directional coupler according to claim 1, wherein each via-hole interval in the first via-hole string, the second via-hole string and the third via-hole string is set to a value smaller than a diameter of the via-hole in an area on which a radio wave propagates in a higher mode not less than a TE20 mode out of the first post-wall waveguide, the second post-wall waveguide and the third post wall waveguides.

3. The short slot directional coupler according to claim 1, wherein the first post wall waveguide and the second post wall wave guide have a shared narrow wall surface therebetween.

4. A Butler matrix comprising:

a plurality of hybrid couplers each comprised of the short slot directional coupler of claim 3;

a plurality of cross couplers each comprised of the short slot directional coupler of claim 3; and a plurality of a phase shifter comprised of the third post-wall waveguide of claim 3.

5. A Butler matrix comprising:

a plurality of hybrid couplers each comprised of the short slot directional coupler of claim 1;

a plurality of cross couplers each comprised of the short slot directional coupler of claim 1; and a plurality of a phase shifter comprised of the third post-wall waveguide of claim 1.

6. An automotive radar antenna comprising:

a slot array antenna; and the Butler matrix of claim 5 to provide a power supply to the slot array antenna.

7. A short slot directional coupler comprising:

a dielectric substrate having both surfaces each covered by a metal film;

a first via-hole string and a second via-hole string, each of which has via-holes penetrating through the substrate, and formed so that a distance between the first via-hole string and the second via-hole string is narrow at a center of the string and wider along directions of both ends of the string; and a pair of third via-hole strings each having via-holes penetrating through the substrate, and formed between parts adjacent to both ends of the first via-hole string and parts adjacent to both ends of the second via-hole string to form a first post-wall waveguide along with the first via-hole string and a second post-wall waveguide along with the second via-hole string, wherein the first post wall waveguide, the second post wall waveguide and third post waveguides defined by the first via-hole string and the second via-hole string vary in width in multi-stepped form.

8. A short slot directional coupler comprising:

a first dielectric substrate and a second dielectric substrate whose one-side surfaces are opposed to each other and whose other-side surfaces each are covered by a metal film;

an intermediate dielectric layer interposed between the one-side surfaces of the first dielectric substrate and the second dielectric substrate;

a first via-hole string and a second via-hole string each having via-holes penetrating through the first dielectric substrate and the second dielectric substrate, and formed so that a distance between the first via-hole string and the second via-hole string is narrow at a center of the string along a length direction thereof and wider along directions of both ends of the string; and a pair of third via-hole strings each having via-holes penetrating through the first dielectric substrate, the intermediate dielectric layer and the second dielectric substrate, and formed between parts adjacent to both ends of the first via-hole string and parts adjacent to both ends of the second via-hole string to form a first post-wall waveguide along with the first via-hole string and a second post-wall waveguide along with the second via-hole string, wherein each via-hole interval in the first via-hole string, the second via-hole string and the third via-hole string is set to a value not more than 90% in an area on which each width of the first post-wall waveguide, the second post-wall waveguide and third post wall waveguides defined by the first via-hole string and the second via-hole string satisfies a following equation:

$$w > \frac{1}{f_0}\frac{c}{\sqrt{\varepsilon_r}}$$

where $f_0$ represents an operating frequency, $\in_r$ represents a relative conductivity of the substrate, and c represents a light velocity.

9. The directional coupler according to claim 8, wherein each via-hole interval in the first via-hole string, the second via-hole string and the third via-hole string is set to a value smaller than a diameter of the via-hole in an area on which a radio wave propagates in a higher mode not less than a TE20 mode out of the first post-wall waveguide, the second post-wall waveguide and the third post wall waveguides.

* * * * *